US007513448B2

(12) United States Patent
Ko

(10) Patent No.: US 7,513,448 B2
(45) Date of Patent: Apr. 7, 2009

(54) PAPER AND OPTICAL DISK SHREDDER

(76) Inventor: Joseph Y. Ko, 9767 Research Rd., Irving, CA (US) 92618

( * ) Notice: Subject to any disclaimer, the term of this patent is extended or adjusted under 35 U.S.C. 154(b) by 598 days.

(21) Appl. No.: 11/353,039

(22) Filed: Feb. 14, 2006

(65) Prior Publication Data

US 2007/0187536 A1 Aug. 16, 2007

(51) Int. Cl.
*B02B 7/02* (2006.01)
*B02C 19/00* (2006.01)
*B02C 23/00* (2006.01)

(52) U.S. Cl. ..... 241/100; 241/236

(58) Field of Classification Search ..... 241/100, 241/101.2, 236
See application file for complete search history.

(56) References Cited

U.S. PATENT DOCUMENTS 3,682,402 A * 8/1972 Goldhammer ..... 241/100
6,676,050 B2 * 1/2004 Chang ..... 241/37.5
RE40,042 E * 2/2008 Chang ..... 241/36

FOREIGN PATENT DOCUMENTS

TW 524199 3/2003

* cited by examiner

*Primary Examiner*—Bena Miller
(74) *Attorney, Agent, or Firm*—Muncy, Geissler, Olds & Lowe, PLLC

(57) ABSTRACT

A paper and optical disk shredder with a shredding optical disk bucket switching apparatus has a head capable of shredding paper and optical disks. The head has a sensor to detect insertion of an object. The head is mounted onto a casing which holds a shredding paper bucket. The shredding paper bucket holds a shredding disk bucket. The shredding disk bucket has a plurality of sliding members and is coupled with a transmission means. The transmission means is located on the casing and can switch the shredding disk bucket. The head further has a safety micro-switch to detect proper positioning of the shredding paper bucket and an optical control means to detect overflow condition of the shredding paper or optical disks. Therefore users and the machine can be protected, and an alert is generated to inform the users to clear the shredded disks and paper.

13 Claims, 9 Drawing Sheets

PAPER AND OPTICAL DISK SHREDDER

FIELD OF THE INVENTION

The present invention relates to a paper and optical disk shredder and particularly to a paper and optical disk shredder with a shredding optical disk bucket switching apparatus.

BACKGROUND OF THE INVENTION

Paper and optical disks are the most widely used media for recording data these days. To prevent the data from leaking outside, confidential data have to be destroyed. Destroying the data manually cannot thoroughly shred the paper and optical disks, and could result in leaking of the data.

R.O.C. patent publication No. 524199 entitled "Optical disk data destroyer" discloses a machine to destroy optical disks. It has a casing containing a hollow housing chamber, an inlet on the casing to receive optical disks, an outlet on an opposing side of the inlet, a calender consisting of two embossing rollers located in the housing chamber in a parallel manner, a motor transmission means containing a motor located in the housing chamber and a gear set to drive the calender, and a sensor located on the inlet of the casing to generate a signal when an optical disk is inserted into the inlet to activate the motor transmission means and calender. The calender compresses the surface of the optical disk to form a permanent damage so that the data contained in the optical disk are thoroughly destroyed to prevent leaking of the data.

Due to the demand of the paper and optical disk shredder grows constantly, a composite paper shredder capable of shredding optical disks has been developed on the market. It can destroy both paper and optical disks.

However, the composite shredder mentioned above gathers the shredded paper and optical disks in a same place. As the shredded paper and optical disks are different materials, gathering them together makes classifying difficult and creates a lot of problems in the recycling process.

SUMMARY OF THE INVENTION

Therefore the primary object of the present invention is to solve the aforesaid disadvantages. The present invention provides a paper and optical disk shredder with a shredding optical disk bucket switching apparatus that can separately hold shredded paper and shredded optical disks. The paper and optical disk shredder includes a head for shredding paper and optical disks. The head has a sensor to detect insertion of an object. The head is mounted onto a casing which houses a shredding paper bucket. A shredding disk bucket is mounted onto the shredding paper bucket. The shredding disk bucket has a plurality of sliding members and is coupled with a transmission means which is located on the casing. The transmission means includes a mechanism consisting of linking magnets, gears, ropes, belts and springs to move by pushing, pulling, rotating, levering, and depressing.

In addition, there is a safety micro-switch located on the bottom of the head to detect whether the shredding paper bucket is positioned properly to prevent the shredder from operating while users remove the shredding paper bucket to avoid accidents. Moreover, the shredding paper bucket and shredding optical disk bucket have an optical control means to detect whether the buckets are overflow to prevent shredded debris from jamming the machine and causing fire breakout in the event of user negligence.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
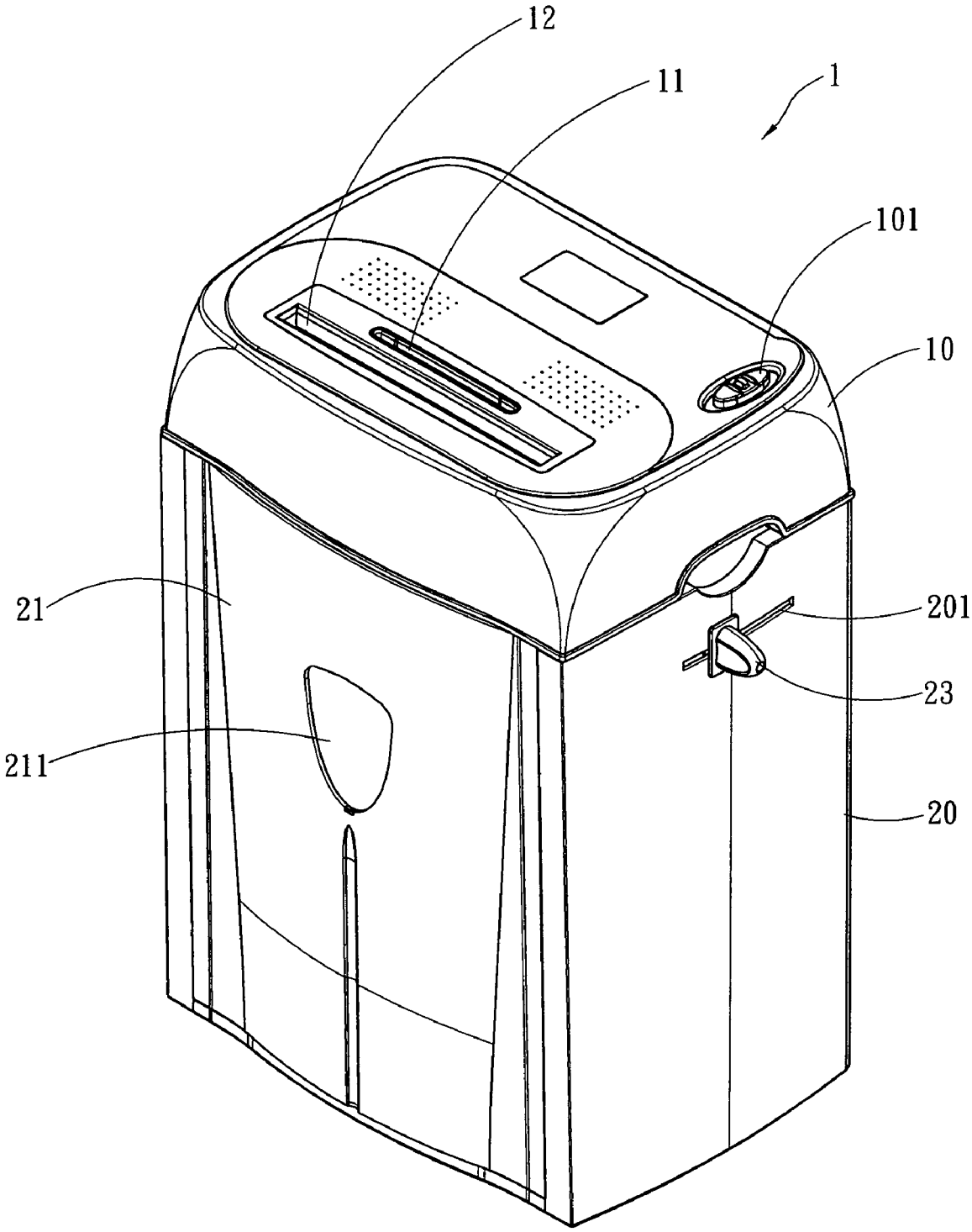
FIG. 1 is a perspective view of the present invention.
Figure 2:
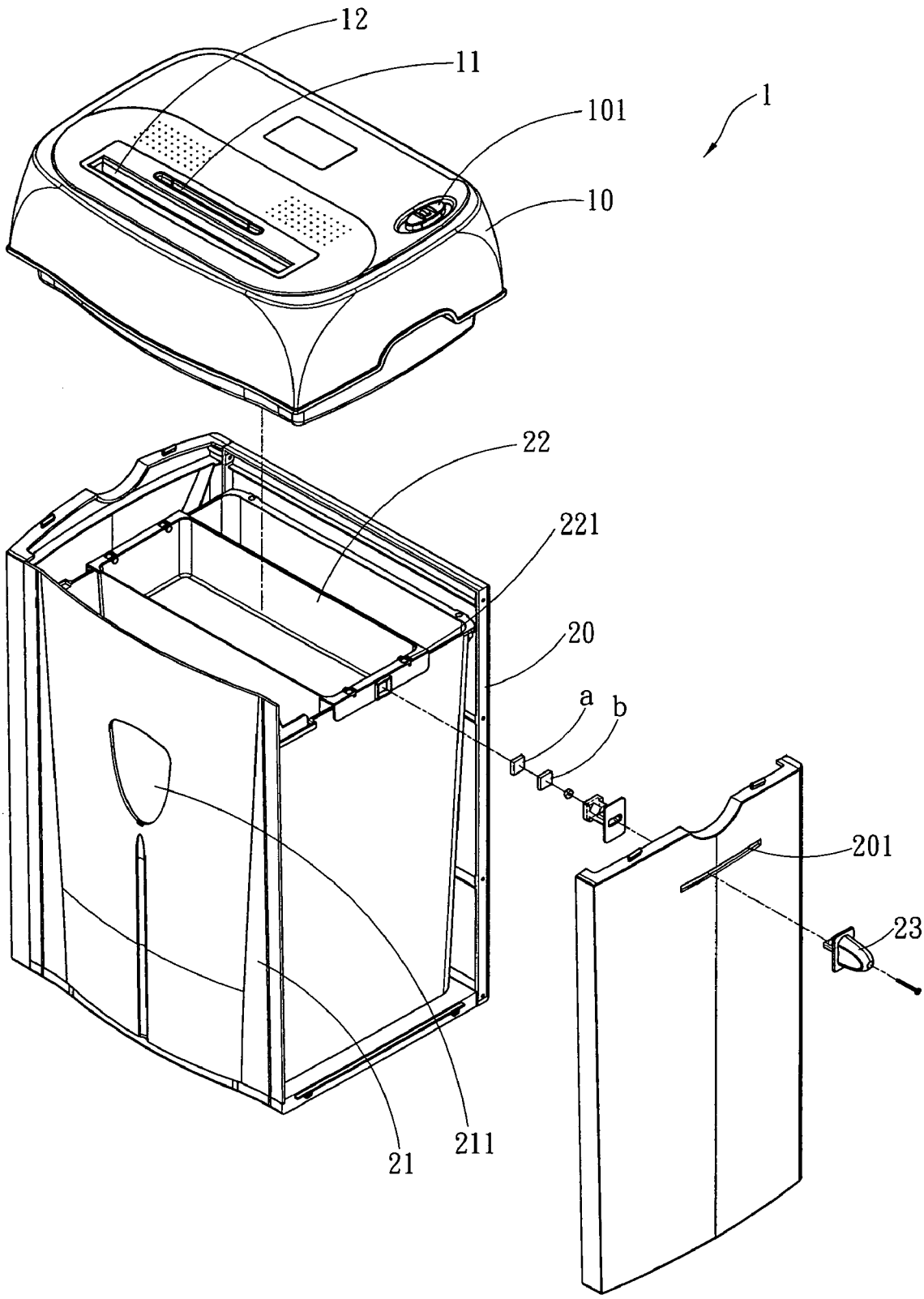
FIG. 2 is an exploded view of the present invention.
Figure 3A:
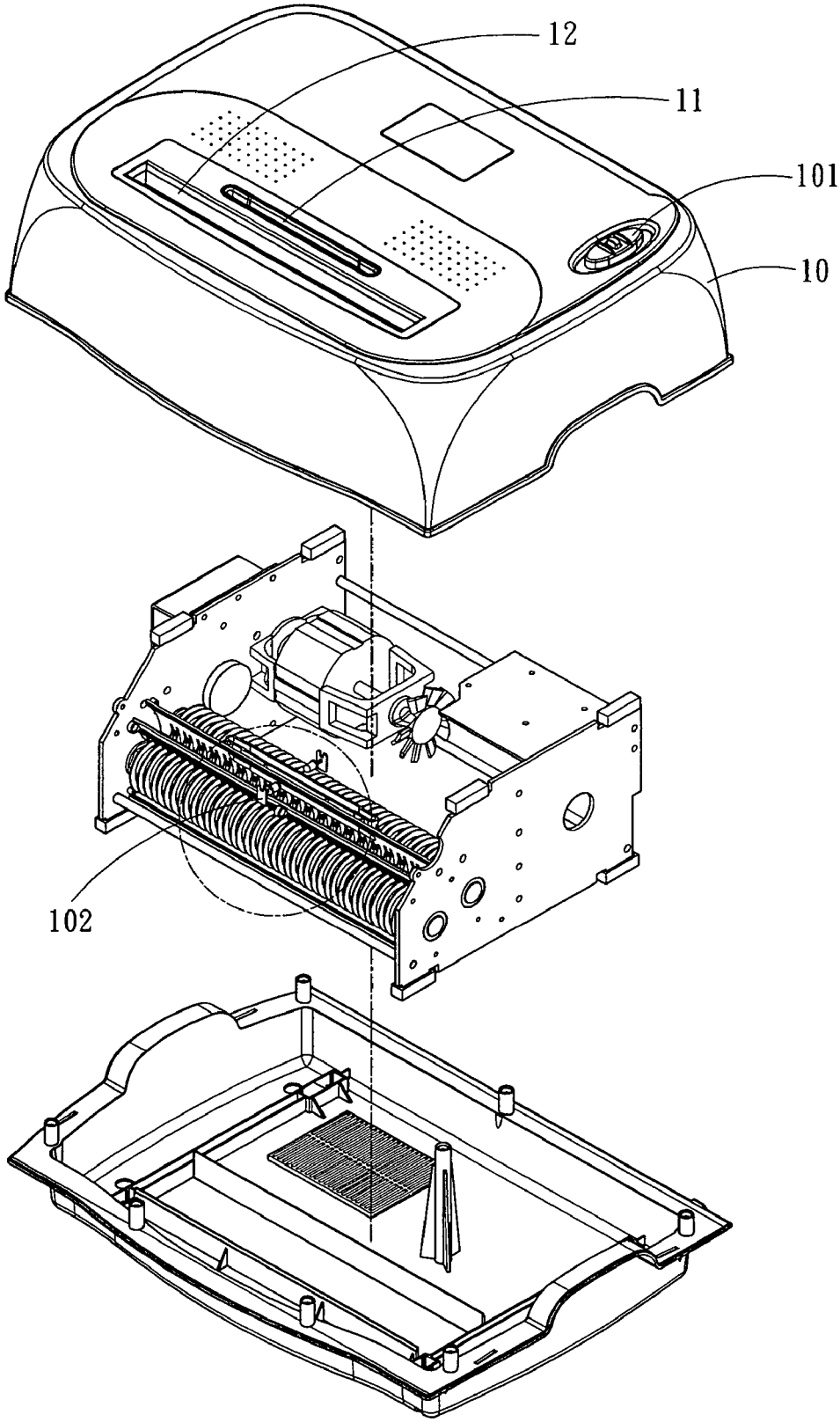
FIG. 3A is an exploded view of the head of the invention.
Figure 3B:
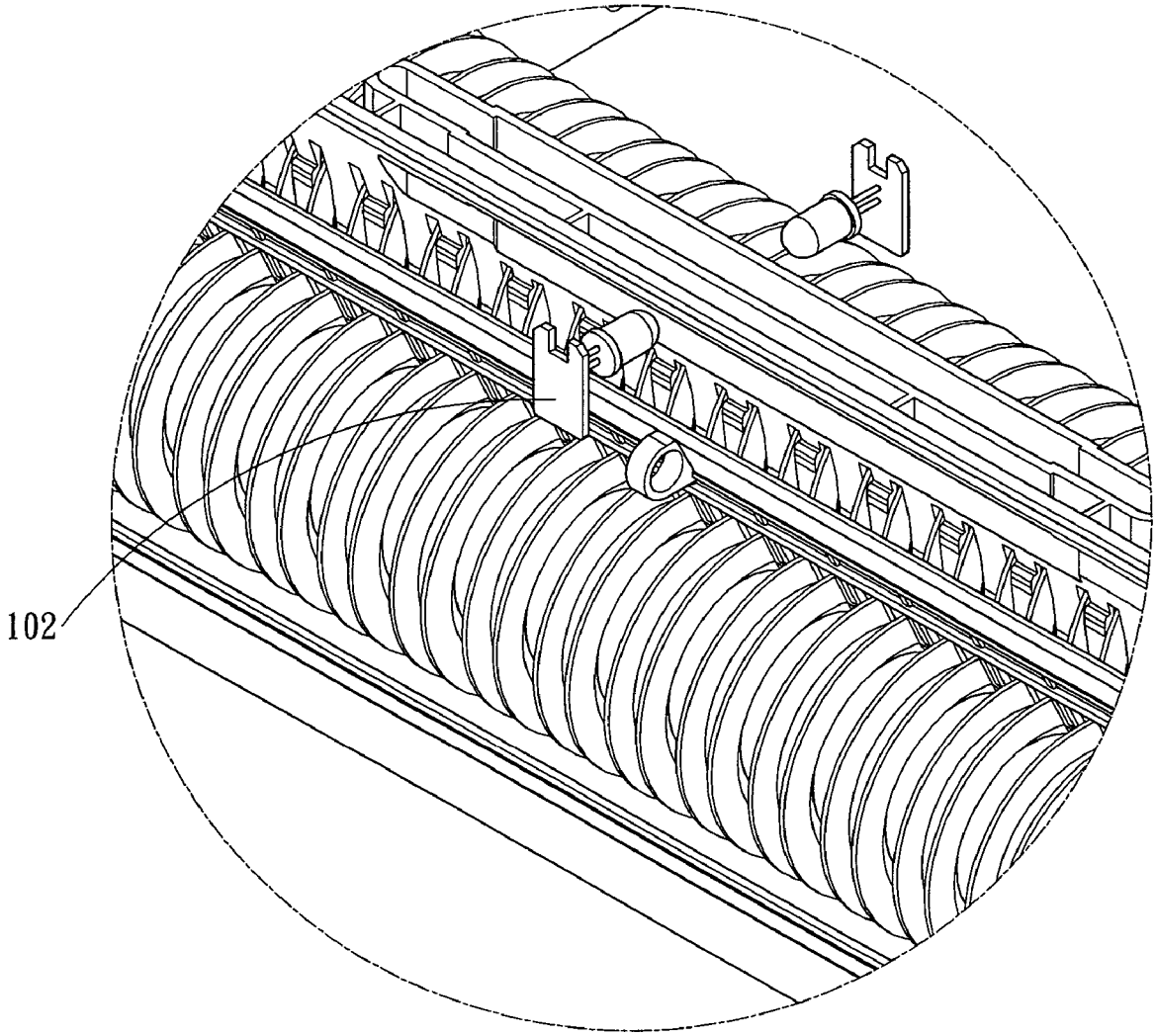
FIG. 3B is a fragmentary enlarged view of the invention.

Please referring to FIGS. 1 and 2, the paper and optical disk shredding machine 1 according to the invention includes a head 10 for shredding paper and optical disks. The head 10 has a power switch 101 and a sensor 102 to detect insertion of an object (also referring to FIGS. 3A and 3B). The head 10 is mounted onto a casing 20 which holds a shredding paper bucket 21. The shredding paper bucket 21 has a handle 211 to facilitate moving thereof. There is a shredding disk bucket 22 mounting onto the shredding paper bucket 21. The shredding disk bucket 22 has a plurality of sliding members 221 on two sides (the sliding members 221 may be rollers or bulged balls) and is coupled with a transmission means. The sliding members 221 enable the shredding disk bucket 22 to slide on the shredding paper bucket 21. Moreover, the shredding paper bucket 21 has a groove (not shown in the drawings) on two ends to allow the shredding disk bucket 22 to be moved thereon. The transmission means may be a push bar, rotary wheel or belt mechanism, and is located on the casing 20. The transmission means may be linked through magnets, gears, ropes, belts, springs and the like that are moved by pushing, pulling, rotating, levering, and depressing. Referring to FIG. 2, the transmission means is a push bar 23 located in a slot 201 of the casing 20. Through the principle of attraction of magnets a and b, the shredding disk bucket 22 is coupled. The magnet a is installed on one side of the shredding disk bucket 22, while another magnet b is installed on one end of the push bar 23 corresponding to the magnet a. Therefore the shredding disk bucket 22 can be moved through the push bar 23. For shredding optical disks, push the push bar 23 to move the shredding disk bucket 22 below an optical disk shredding orifice 11. For shredding paper, push the push bar 23 to move the shredding disk bucket 22 away from a paper shredding orifice 12. Thereby the garbage can be classified.

Figure 4A:
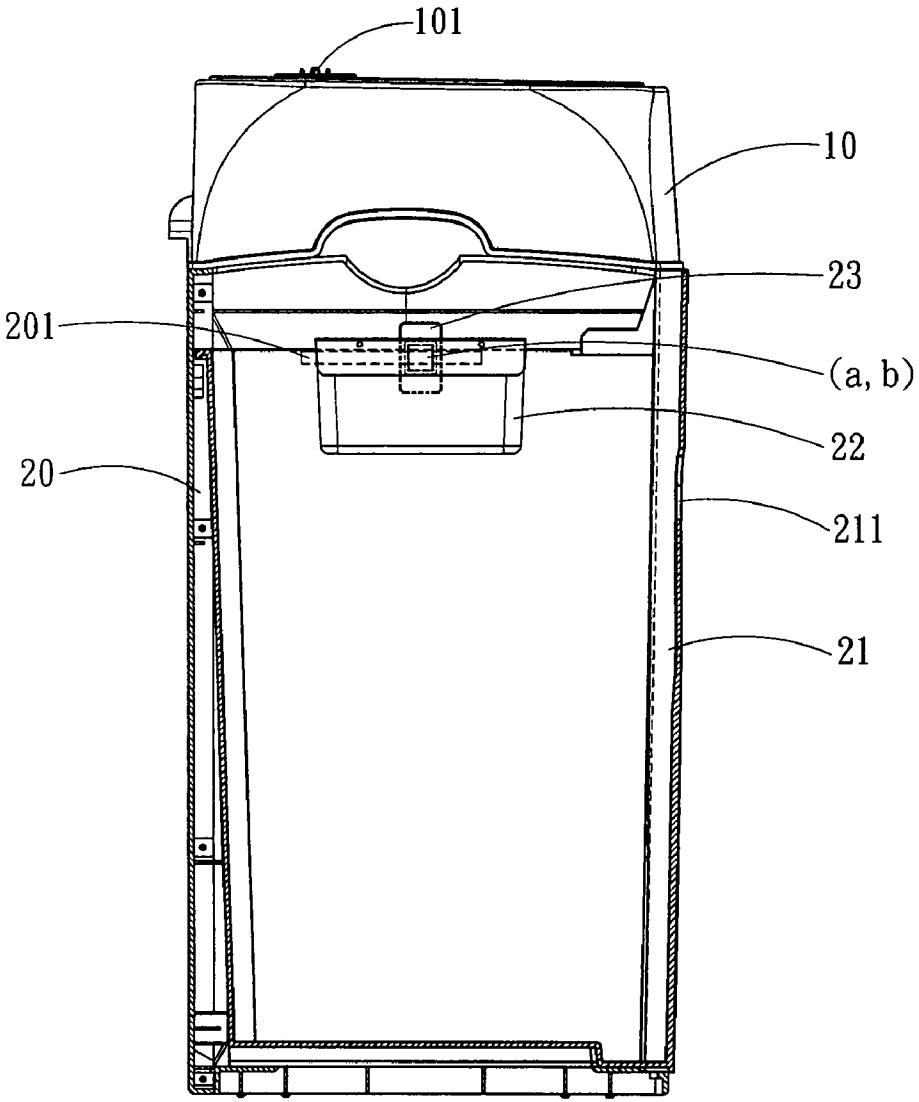
FIG. 4A is a schematic view of the present invention in an operating condition.
Figure 4B:
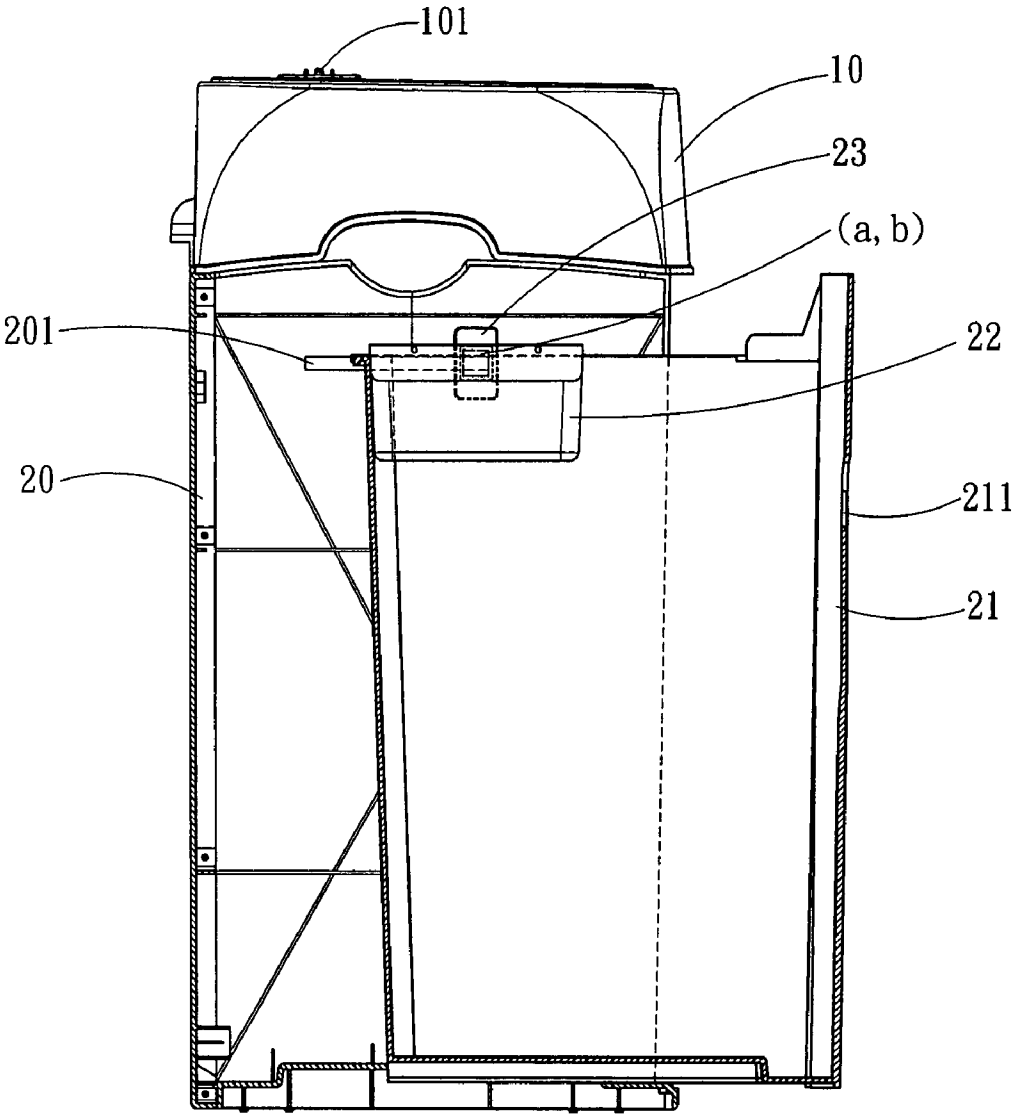
FIG. 4B is a schematic view of the present invention in another operating condition.
Figure 4C:
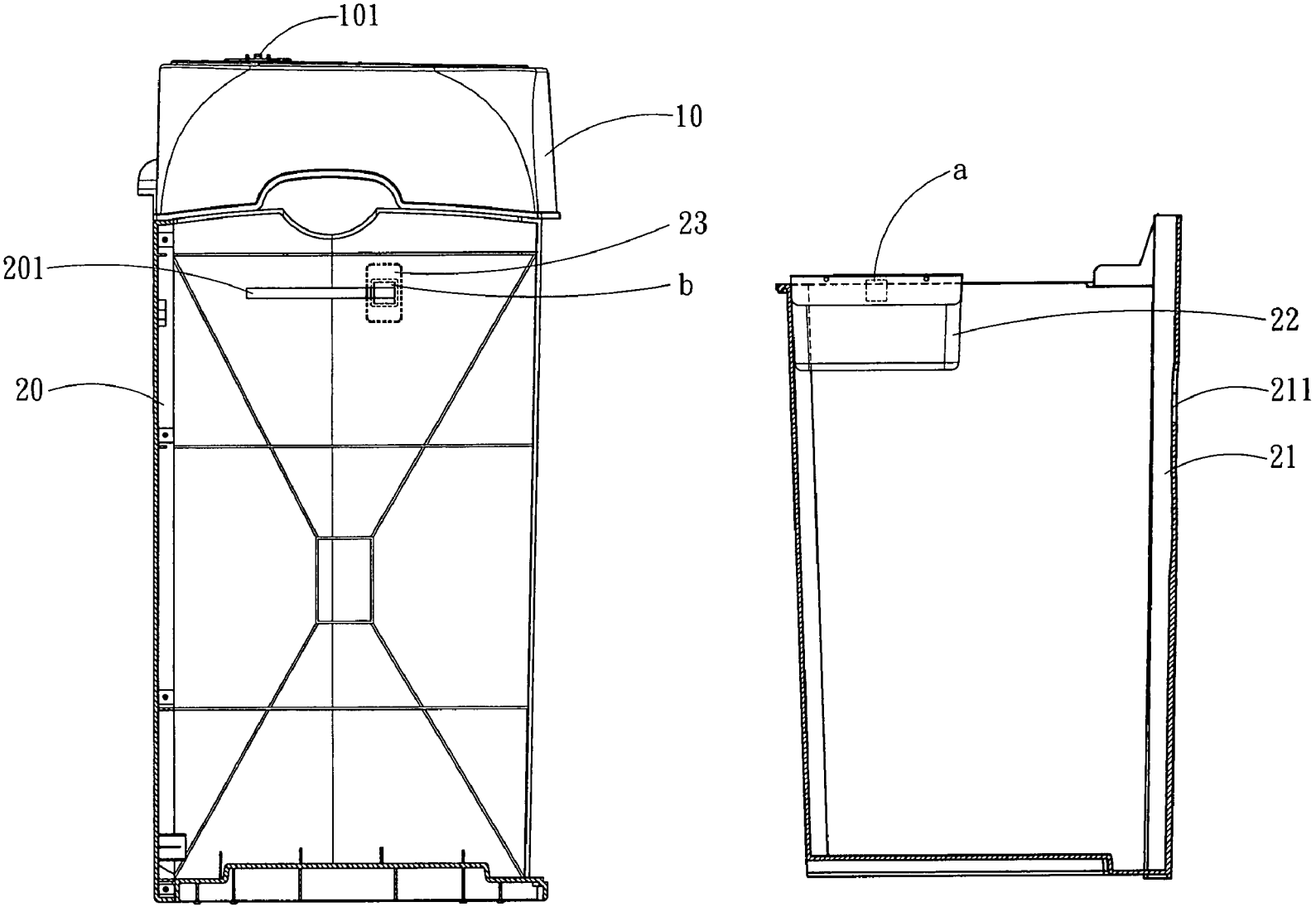
FIG. 4C is a schematic view of the present invention in yet another operating condition.

Refer to FIGS. 4A, 4B and 4C for the invention in operating conditions. When the shredding paper bucket 21 is pulled out through the handle 211, the magnet a of the transmission means attached to the shredding paper bucket 21 is automatically moved away from the magnet b, thereby the shredding disk bucket 22 can be moved away through the pulling movement of the shredding paper bucket 21. On the other hand, when the shredding paper bucket 21 is pushed inwards, the magnet b of the transmission means automatically attracts the magnet a.

Figure 5A:
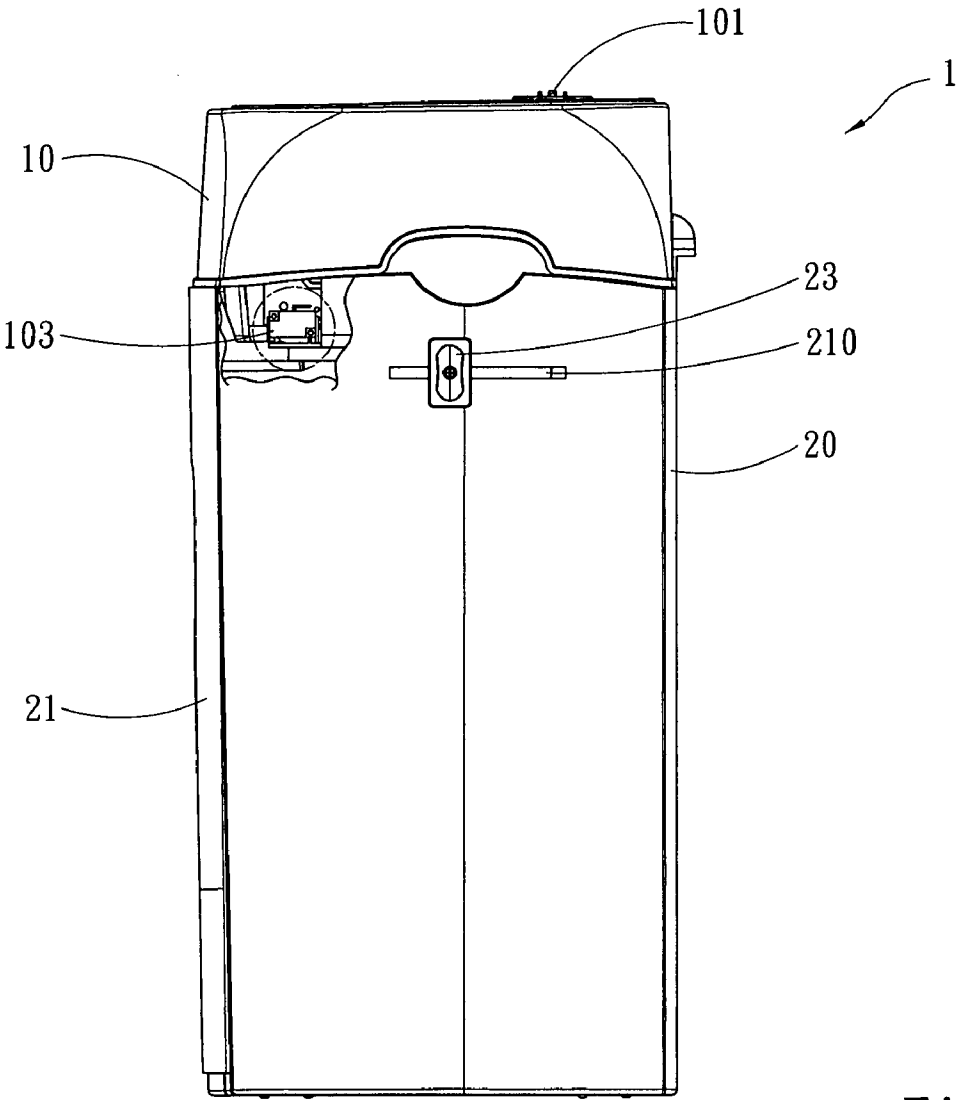
FIG. 5A is a fragmentary sectional view of another embodiment of the head of the invention.
Figure 5B:
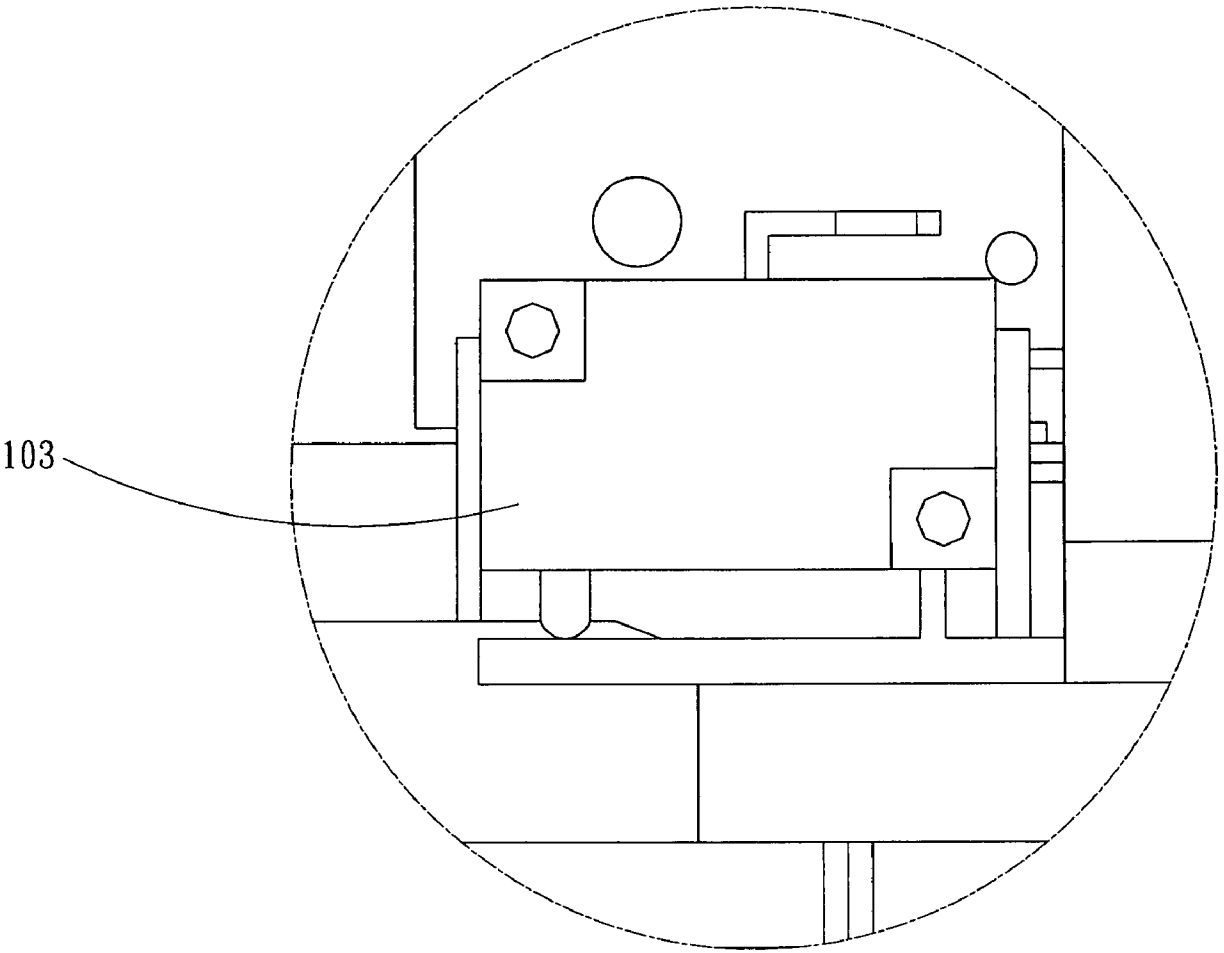
FIG. 5B is a fragmentary enlarged view according to FIG. 5A.

In addition, the head 10 may have a safety micro-switch 103 located on the bottom to detect whether the shredding paper bucket 21 is properly positioned (referring to FIGS. 5A and 5B). The safety micro-switch 103 may be a safety means selecting from a tenon, linkage bar, pressing bar, pushing bar, optical control means, magnetic control means and the like. When the power switch 101 is activated and the shredding paper bucket 21 is positioned properly, a circuit is ON to start operation of the paper and optical shredding machine 1. On the contrary, when the shredding paper bucket 21 is moved out, the circuit is OFF and the paper and optical shredding machine 1 cannot operate. Therefore a double safety protection is provided for users.

Moreover, an optical control means (not shown in the drawings) may be installed on one wall of the shredding paper bucket 21 and shredding disk bucket 22 to detect whether overflow occurs. It detects the debris in the bucket through an infrared light. When the debris held in the bucket reaches a selected level, it is detected by an infrared signal and the power supply is cut off. Thus in the event that the shredding paper bucket 21 or shredding disk bucket 22 is full and users are not aware, the shredder stops shredding to prevent the debris from jamming the machine and causing fire breakout.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A paper and optical disk shredder with a shredding optical disk bucket switching apparatus, comprising:

a head for shredding paper and optical disks;

a casing for holding the head;

a shredding paper bucket located in the casing;

a shredding disk bucket mounted onto the shredding paper bucket having a plurality of sliding members; and a transmission means which is located on the casing and coupled with the shredding disk bucket.

2. The paper and optical disk shredder of claim 1, wherein the head has a safety micro-switch to detect positioning of the shredding paper bucket.

3. The paper and optical disk shredder of claim 1, wherein the head has a sensor to detect insertion of an object.

4. The paper and optical disk shredder of claim 1, wherein the shredding paper bucket and the shredding disk bucket have an optical control means to detect an overflow condition.

5. The paper and optical disk shredder of claim 1, wherein the shredding paper bucket has a handle.

6. The paper and optical disk shredder of claim 1, wherein the shredding paper bucket has a groove to allow the sliding members to move.

7. The paper and optical disk shredder of claim 1, wherein the transmission means is a push bar.

8. The paper and optical disk shredder of claim 1, wherein the transmission means is a rotary wheel.

9. The paper and optical disk shredder of claim 1, wherein the transmission means is a belt.

10. The paper and optical disk shredder of claim 1, wherein the transmission means is a spring.

11. The paper and optical disk shredder of claim 1, wherein the casing has a slot.

12. The paper and optical disk shredder of claim 1, wherein the sliding members are rollers.

13. The paper and optical disk shredder of claim 1, wherein the sliding members are bulged balls.

* * * * *